US009944421B2

(12) United States Patent
Ford

(10) Patent No.: US 9,944,421 B2
(45) Date of Patent: Apr. 17, 2018

(54) FLIGHT LUG FOR OCTAGONAL CARTONS

(71) Applicant: Graphic Packaging International, Inc., Atlanta, GA (US)

(72) Inventor: Colin P. Ford, Woodstock, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 398 days.

(21) Appl. No.: 14/585,343

(22) Filed: Dec. 30, 2014

(65) Prior Publication Data

US 2015/0111713 A1 Apr. 23, 2015

Related U.S. Application Data

(62) Division of application No. 13/005,784, filed on Jan. 13, 2011, now Pat. No. 8,951,177.

(Continued)

(51) Int. Cl.
*B65B 43/26* (2006.01)
*B65B 43/32* (2006.01)

(Continued)

(52) U.S. Cl.
CPC ..... *B65B 43/325* (2013.01); *B65D 5/029* (2013.01); *B31B 50/002* (2017.08); *B31B 50/78* (2017.08);

(Continued)

(58) Field of Classification Search
CPC ..... B65B 43/26; B65B 43/265; B65B 43/24; B65B 43/325; B31B 1/78; B31B 2201/281; B31B 2201/282; B31B 50/78; B31B 50/782; B31B 50/002; B31B 2100/00; B31B 2120/30; B65D 5/029
See application file for complete search history.

(56) References Cited

U.S. PATENT DOCUMENTS 1,782,451 A * 11/1930 Waisner ..... F27B 9/243 432/123
2,021,453 A * 11/1935 Levin ..... E21F 13/02 198/732

(Continued)

FOREIGN PATENT DOCUMENTS

DE 196 81 098 2/1995
DE 197 11 415 3/1997

(Continued)

OTHER PUBLICATIONS

European Search Report for EP 11 00 0228 dated May 6, 2011.

(Continued)

*Primary Examiner* — Christopher R Harmon
(74) *Attorney, Agent, or Firm* — Womble Bond Dickinson (US) LLP

(57) ABSTRACT

A carton conveyer for a packaging machine has upper and lower flights to which sets of flight lugs are attached. Each set of flight lugs comprises leading flight lugs and trailing flight lugs and the leading flight lugs have recesses that face and oppose recesses on the trailing flight lugs. The recesses are formed to confine an open carton therebetween. Notches are formed in the flight lugs in such a way that movement of the leading and trailing flight lugs toward one another causes an un-erected carton between the lugs to be captured and erected.

16 Claims, 5 Drawing Sheets

Related U.S. Application Data

(60) Provisional application No. 61/295,349, filed on Jan. 15, 2010.

(51) Int. Cl.

| | |
|---|---|
| ***B65D 5/02*** | (2006.01) |
| *B65B 43/24* | (2006.01) |
| *B31B 50/78* | (2017.01) |
| *B31B 100/00* | (2017.01) |
| *B31B 120/30* | (2017.01) |
| *B31B 50/00* | (2017.01) |

(52) U.S. Cl.

CPC ..... *B31B 50/782* (2017.08); *B31B 2100/00* (2017.08); *B31B 2120/30* (2017.08); *B65B 43/24* (2013.01); *B65B 43/26* (2013.01); *B65B 43/265* (2013.01)

(56) References Cited

U.S. PATENT DOCUMENTS

| | | | | | |
|---|---|---|---|---|---|
| 2,372,925 | A * | 4/1945 | Ball | B65G 19/22 | 198/734 |
| 2,424,229 | A * | 7/1947 | Erisman | F26B 17/06 | 34/378 |
| 2,570,145 | A * | 10/1951 | Mettler | B31B 1/00 | 229/145 |
| 3,066,579 | A * | 12/1962 | Brush | B31B 1/00 | 493/181 |
| 3,821,874 | A | 7/1974 | Jones | | |
| 4,012,887 | A | 3/1977 | Calvert et al. | | |
| 4,237,673 | A | 12/1980 | Calvert et al. | | |
| 4,518,301 | A | 5/1985 | Greenwell | | |
| 4,544,368 | A | 10/1985 | Labombarde | | |
| 4,614,079 | A | 9/1986 | Ida et al. | | |
| 4,685,275 | A | 8/1987 | Nigrelli, Sr. | | |
| 4,784,253 | A * | 11/1988 | Gibbemeyer | B29C 49/4205 | 198/418.6 |
| 5,042,636 | A * | 8/1991 | Underwood | B65G 47/71 | 198/440 |
| 5,234,314 | A | 8/1993 | Ganz | | |
| 5,496,545 | A | 3/1996 | Holmes-Farley et al. | | |
| 5,531,661 | A | 7/1996 | Moncrief | | |
| 5,628,450 | A | 5/1997 | Cromwell et al. | | |
| 6,279,301 | B1 | 8/2001 | Corniani et al. | | |
| 7,316,642 | B2 * | 1/2008 | Martelli | B65B 43/305 | 493/309 |
| 7,510,516 | B2 | 3/2009 | Zetterstrom et al. | | |
| 8,617,039 | B2 | 12/2013 | Zetterstrom et al. | | |
| 2008/0202628 | A1 * | 8/2008 | Ehrsam | A61D 19/022 | 141/4 |

FOREIGN PATENT DOCUMENTS

| | | |
|---|---|---|
| EP | 425 226 | 5/1991 |
| EP | 615 909 | 9/1994 |
| EP | 1 062 160 | 7/1999 |
| EP | 1 344 716 | 9/2003 |
| WO | WO 99/36323 | 7/1999 |
| WO | WO 2006/064341 A1 | 6/2006 |

OTHER PUBLICATIONS

Office Action for U.S. Appl. No. 13/005,784 dated Apr. 7, 2014.
Response to Restriction Requirement for U.S. Appl. No. 13/005,784 dated Apr. 25, 2014.
Office Action for U.S. Appl. No. 13/005,784 dated May 8, 2014.
Amendment A and Response to Office Action for U.S. Appl. No. 13/005,784 dated Aug. 7, 2014.
Notice of Allowance and Fee(s) Due for U.S. Appl. No. 13/005,784 dated Oct. 16, 2014.
Part B—Fee(s) Transmittal for U.S. Appl. No. 13/005,784 dated Dec. 30, 2014.

* cited by examiner

FLIGHT LUG FOR OCTAGONAL CARTONS

RELATED APPLICATIONS

This application is a divisional of U.S. patent application Ser. No. 13/005,784, filed Jan. 13, 2011, which claims the benefit of U.S. Provisional Application No. 61/295,349, filed Jan. 15, 2010.

INCORPORATION BY REFERENCE

The entire contents of U.S. patent application Ser. No. 13/005,784, filed Jan. 13, 2011, and U.S. Provisional Application No. 61/295,349, filed Jan. 15, 2010, is hereby incorporated by reference as if presented herein in their entirety.

TECHNICAL FIELD

This disclosure relates generally to carton packaging machines and more specifically to carton flight lugs of a carton conveyor of such machines.

BACKGROUND

Carton conveyors are components of high speed continuous motion article packaging machines. Generally, a carton conveyor moves open cartons in a uniformly spaced relationship and in a downstream direction. Articles to be packaged, such as beverage cans or single large beverage containers, are progressively pushed into the open cartons as they are conveyed along, and the cartons are subsequently closed to contain the articles. FIG. 1 illustrates a generic carton conveyor in simplified form for clarity. The carton conveyor 11 essentially comprises a spaced pair of endless chains that move around spaced apart sprockets. More specifically, the conveyor 11 in FIG. 1 has an upper carton flight 12 that moves in a downstream direction 17 and a lower flight 13 that returns in the opposite direction. The flights travel around an upstream sprocket 19 and a downstream sprocket 18. Trailing flight lugs 14 and leading flight lugs 15 are attached to and are carried along with the chains of the conveyor. The pairs of flight lugs are spaced along the chains to separate, contain, and confine cartons 16 of a specific size and to convey the cartons 16 in the downstream direction 17 for being loaded with articles. In some cases, the cartons 16 are pre-erected by a carton erector and delivered to the upper flight 12, as indicated schematically on the left in FIG. 1. Those of skill in the art will understand that carton conveyors of packaging machines are significantly more complex than illustrated in FIG. 1. A more detailed example is disclosed in U.S. Pat. No. 5,234,314, owned by the assignee of the present invention, the contents of which are hereby incorporated fully by reference.

There is a market demand for articles packaged in octagonal cartons; that is, cartons having eight sides. Erecting octagonal cartons, delivering them to a carton conveyor, and maintaining their shape accurately as they move downstream along the carton conveyor presents unique challenges. A need exists for a method and apparatus that will erect octagonal cartons accurately and consistently and hold them in shape for receiving articles to be packaged as they move downstream along the upper or carton flight of a carton conveyor. More broadly, a need exist for a method and apparatus for erecting and conveying non-rectangular cartons along a carton flight. It is to the provision of such a method and apparatus that the present invention is primarily directed.

SUMMARY

U.S. provisional application No. 61/295,349, to which priority is claimed above, is hereby incorporated by reference in its entirety.

Briefly described, a carton conveyor for a packaging machine has endless carton conveyor chains with upper or carton flights that moves in a downstream direction and lower flights that return in an upstream direction. Sets of spaced apart flight lugs are secured to the chains of the conveyor and move therewith. Each set of flight lugs includes a pair of leading lugs and a pair of trailing lugs, and the leading and trailing lugs have facing recesses shaped to conform substantially to the sides of an octagonal carton disposed between the lugs. Notches are formed within the recesses.

An articulating lug conveyor has a pair of endless chains each with an upper flight and a lower flight and is positioned upstream of the carton conveyor. The downstream sprockets of the articulating lug chains may be coaxial with the upstream sprockets of the carton conveyor chains so that the downstream end of the articulating lug conveyor and the upstream end of the carton conveyor are substantially co-located. Pairs of articulating lugs are attached at spaced intervals to respective articulating lug chains and are moved by the chains in a downstream direction toward the upstream end of the carton conveyor. Each articulating lug is pivotable or otherwise movable between a raised operative orientation and a lowered inoperative orientation. The upper flights of the articulating lug chains, and thus the articulating lugs, move downstream at a speed or rate that is greater than the rate at which the upper flight, and thus the carton flight lugs, of the carton conveyor chains move.

In use, octagonal carton blanks in their flat or un-erected configurations are delivered to the upper flights of the articulating lug chains. The articulating lugs, which are in their raised operative orientations, engage and progressively move the carton blanks in sequence downstream toward the carton conveyor. As each carton blank reaches the carton conveyor, it is driven by its faster moving articulating lugs against a leading lug on the upper flight of the carton conveyor. Further accelerated movement of the articulating lugs pushes the leading edge of the blank up a sloped lower surface of the leading flight lug until the leading edge engages with a notch formed at the top of the lower surface. At this point, the articulating lugs drop away to their lowered inoperative orientations.

Just as the articulating lugs drop away, the trailing lugs of the carton flight lug set round the upstream sprocket of the carton conveyor chain and engage the trailing edge of the un-erected carton blank, confining the blank between the notches on the leading lugs and the trailing lugs. As the trailing lugs continue to round the upstream sprocket, they progressively close the space between themselves and the leading lugs and thereby begin to compress the carton blank between the trailing and leading lugs. Further movement of the trailing lugs around the sprocket and onto the upper flight of the conveyor moves the lugs of the set closer to their spaced parallel positions, which causes the octagonal carton to be progressively erected to its fully open configuration between the leading and trailing lugs. Accordingly, when the trailing lugs have fully rounded the upstream sprocket, the octagonal carton is fully erected. Further, it is confined and held in its octagonal shape by the facing recesses of the flight lugs between which it is captured so that articles can be loaded into the carton without incident.

Thus, an apparatus and method that addresses the challenges discussed above is disclosed. The apparatus and method will be better understood upon review of the detailed description set forth below, when taken in conjunction with the accompanying drawing figures, which are briefly described as follows.

DETAILED DESCRIPTION

Figure 2:
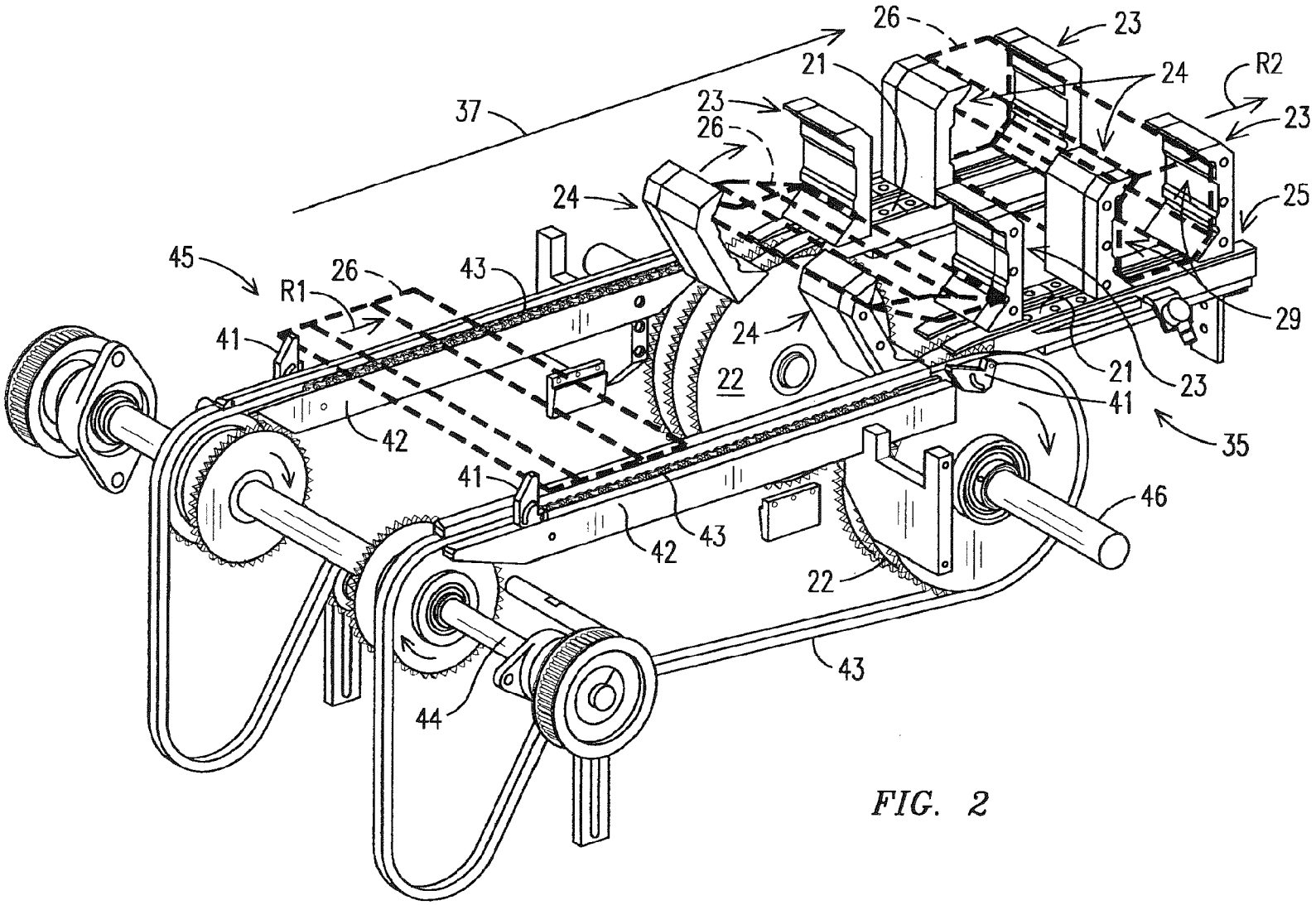
FIG. 2 is a perspective illustration of a carton blank conveyor and erection system for octagonal cartons that embodies principles of the invention.

Referring now in more detail to the drawing figures, in which like reference numerals indicate like parts throughout the several views, FIG. 2 illustrates a system for conveying and erecting octagonal cartons according to one aspect of the invention. The system comprises an upstream carton blank conveyor 45 and a downstream carton conveyor 35. The downstream end of the carton blank conveyor 45 is substantially co-located with the upstream end of the carton conveyor 35. The carton blank conveyor 45 includes a pair of endless articulating lug chains 43, the upper flights of which move in the downstream direction 37 along respective lug rails 42. Articulating lugs 41 are attached to the lug chains 43 and are arranged in pairs as shown. Each articulating lug 41 is movable between a raised or operable orientation as shown at the upstream end of the lug rails 42 in FIG. 2, and a lowered or inoperable orientation as shown at the downstream end of the lug rails 42. In the illustrated embodiment, the lug rails 42 hold the articulating lugs 41 in their raised operative orientations as they move along the upper flights of the articulating lug chains. At the downstream terminal ends of the lug rails, however, the articulating lugs are allowed to pivot or fall away to their lowered or inoperable orientations, as seen just above the shaft 46 in FIG. 2. The articulating lug chain 43 is moved by drive shaft 44 and a motor (not shown) such that the articulating lugs move in the downstream direction 37 at a velocity or rate R1. As shown in phantom lines in FIG. 2, the articulating lugs push octagonal carton blanks 26 in substantially flat unerected configurations toward the upstream end of the carton conveyor 35 at rate R1. While the articulating lugs are shown for clarity pushing the carton blanks from behind, the lugs may push the blanks from other locations such as from behind projecting end flaps of the carton blanks.

The chains of the carton conveyor 35, which are not explicitly shown in FIG. 2, traverse upstream sprockets 22 and carry outwardly projecting flight lugs 23 and 24, which project upwardly when moving along the carton flight 25. Cartons to be conveyed are held and confined between sets of fight lugs as they are moved downstream, as illustrated in phantom lines to the right in FIG. 2. More specifically, each set of flight lugs for confining cartons includes a pair of leading flight lugs 23 and a corresponding pair of trailing flight lugs 24. The leading flight lugs 23 are formed with upstream facing recesses 29 and the trailing flight lugs are formed with downstream facing recesses 29, which face and oppose the recesses of the leading flight lugs. The recesses 29 of the flight lugs are configured to conform to the shape of opposite sides of an octagonal carton 26. Thus, as can be appreciated from FIG. 2, octagonal cartons 26 can be confined within the recesses of the flight lugs and are maintained in their octagonal shapes as they move downstream along the carton flight to be loaded with articles. The flight lugs 23 and 24 are moved by their chains in the downstream direction 37 at a velocity or rate R2, which is the machine speed. The rate R1 of the articulating lugs 41 is greater than the rate R2 of the carton flight lugs.

In operation, as described in more detail below, the carton blank conveyor 42 moves each carton blank toward the carton conveyor 35 until the leading edge of the carton blank is driven into the upstream facing recesses of a pair of leading carton flight lugs 23. More specifically, the leading edge is pushed up angled lower surfaces of the leading lugs until the edge engages notches formed at the tops of the lower surfaces. The articulating lugs then fall away just as the corresponding pair of trailing carton flight lugs 24 round the upstream sprockets 22 and engage the trailing edge of the carton blank. It thus may be said that the articulating lugs fall away to their inoperable orientations and the trailing carton flight lugs 24, in conjunction with the leading carton flight lugs 23, take over control of the carton blank. This prevents the articulating lugs 41 from crushing the carton blanks against the leading carton flight lugs 23 as a result of the fact that the articulating lugs are moving at a rate R1 that is faster than the machine speed or rate R2 at which the carton flight lugs are moving.

With continued reference to FIG. 2, as the pair of trailing carton flight lugs 24 continues to round the sprockets 22, the lugs progressively close the gap and the angle between themselves and their corresponding leading flight lugs 23 until all of the lugs are vertically oriented and parallel as shown to the right in FIG. 2. During this process, the octagonal carton blank is progressively erected between the leading and trailing flight lugs, as discussed in detail below, until it is captured, stabilized, and carried downstream to be loaded with an article or articles in known ways.

Figure 1:
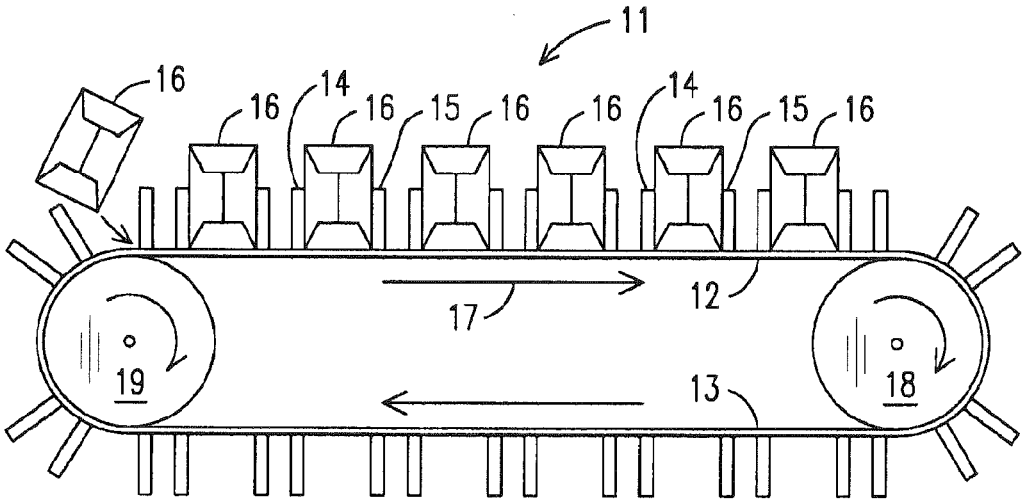
FIG. 1 (PRIOR ART)
FIG. 1 is a simplified side view of a traditional carton conveyor of a packaging machine, and has been discussed above in the Background section of this disclosure.
Figure 3:
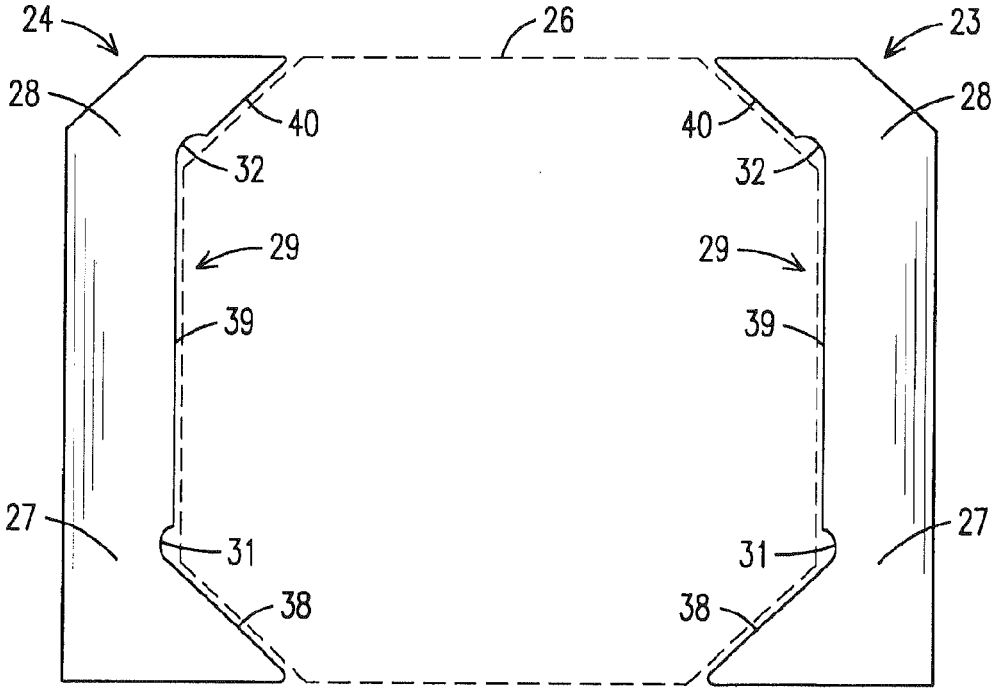
FIG. 3 is a perspective view of one of the carton flight lugs of the carton conveyor of FIG. 2 configured according to the invention.

FIG. 3 illustrates a preferred embodiment of the leading and trailing flight lugs 23 and 24 in more detail. The leading flight lug 23 is detailed here and it will be understood that the trailing flight lug 24 is a mirror image of the leading flight lug 23. Each flight lug 23 has a lower portion 27 that is configured to be secured to a chain of the carton conveyor and an upper portion 28. The recess 29 in the mid-portion of the flight lug is formed with three surfaces that are configured and sized to conform to three adjacent sides of the particular octagonal carton to be accommodated. The three surfaces include a lower surface 38, a middle surface 39, and an upper surface 40. These surfaces engage three of the eight sides of an octagonal carton 26 and the three corresponding surfaces of the trailing lugs 24 engage an opposing three of the eight sides of the carton 26 as shown. For an equiangular octagonal carton, the angle between the surfaces is about 45 degrees to conform to the angles between the sides of the octagonal carton. However, the angle can be any other angle that conforms to the angles between sides of a carton in the event that the carton is not strictly equiangular or not octagonal. Octagonal cartons are thus confined between sets of leading and trailing lugs, which also act to hold the carton in its erected octagonal shape as it moves downstream.

A lower notch 31 and an upper notch 32 are formed at respective intersections of the three surfaces of each flight lug for purposes described in more detail below. The lower notch 31 is formed in the middle surface 39 at the bottom end thereof and the upper notch 32 is formed in the upper surface 40 at its bottom end. The flight lugs can be fabricated from a number of materials known in the art for the fabrication of flight lugs including metal, high density polyurethane, plastics, and the like. Further, they can be molded, machined, cut-out, or otherwise formed in known ways. Preferably, the flight lugs are easily removable and replaceable so that the carton conveyer can be converted quickly and easily to accommodate cartons of different sizes and/or configurations. Further, the leading and trailing lugs may be driven by separate carton conveyor chains that can be phased to move the leading lugs closer together or further apart to accommodate cartons of different sizes.

Referring again to FIG. 2, as each pair of flight lugs moves from the lower flight of the carton conveyor back to the upper flight, they round the upstream sprocket assembly 22 of the carton conveyor and move through an arc from a downward projecting orientation on the return flight to an upward projecting orientation on the carton flight. The leading lugs of a set of lugs moves completely onto the upper flight of the conveyor first, and then the leading edge of a carton blank is driven up their lower surfaces and into the notch 31. Meanwhile, the trailing lugs of the set round the upstream sprocket to fall in behind their corresponding leading lugs. At the moment that the trailing lugs first engage the trailing edge of the blank, the articulating lugs pivot downwardly and fall away to their inoperable orientations. The pair of trailing lugs then moves progressively to a substantially vertical orientation as they complete the arc onto the upper carton flight. Thus, the space between leading and trailing lugs is progressively reduced and the angle between the leading and trailing lugs is also progressively reduced. As discussed below, this motion of the flight lugs in conjunction with the features of the lugs and the carton flight may be used to erect octagonal cartons from a flat configuration to an octagonal configuration.

Figure 4A:
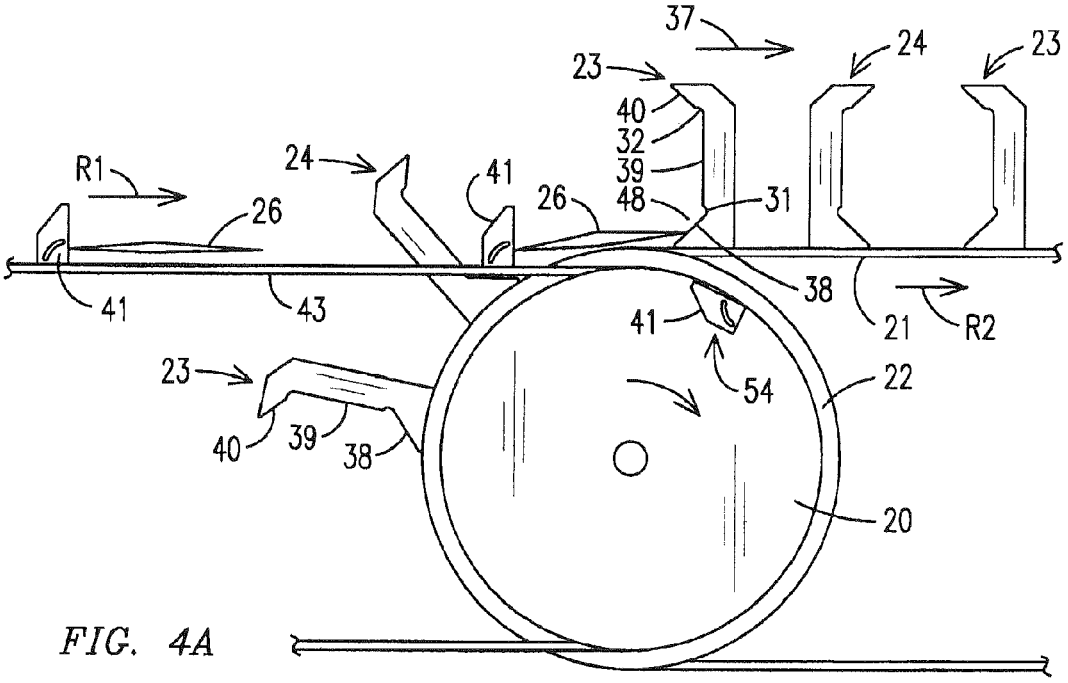
FIGS. 4*a* through 4*f* illustrate in sequence the progressive delivery of a carton blank to a carton conveyor and the subsequent erection of an octagonal carton between flight lugs of a carton conveyor according to principles of the invention.

FIGS. 4*a*-4*f* illustrate in sequence the erection of an octagonal carton between corresponding leading and trailing pairs of carton flight lugs according to the disclosure. Only one of each pair of leading flight lugs and one of each pair of trailing flight lugs as well as one of each pair of articulating lugs is shown in FIGS. 4*a*-4*f*. It will be understood, however, that the other lug of each pair functions the same as described with respect to the lug shown in FIGS. 4*a*-4*f*. In FIG. 4*a*, the leading flight lug 23 is seen to be on the upper carton flight of the carton conveyor assembly 21 in an upright orientation and moving in a downstream direction 41 at the machine speed or rate R1. The corresponding trailing flight lug 24 is just beginning to round the upper portion of the upstream sprocket assembly 22 and is shown in FIG. 4*a* in a substantially horizontal orientation. A carton blank 26 is seen being moved by an articulating lug 41 onto the carton flight behind the leading flight lug 23. As mentioned above, the articulating lugs are moving downstream at a rate R2 that is greater than the machine speed R1 at which the carton flight lugs are moving. As a result, the leading edge of the carton blank 26 is driven or slid up the lower surface 38 of the leading lug 23. When the leading edge of the blank engages within the notch 31 at a slightly later time, the articulating lug 41 moves beyond the flight rail 43 of the articulating lug conveyor and pivots or falls downwardly to its inoperable orientation as shown at 54 in FIG. 4*a* (and 51 in FIG. 4*b*). At the same time, the trailing carton lug 24 engages the trailing edge of the carton blank and takes over control of the blank from the articulating lug. The carton blank is formed with fold lines and creases as is known in the art that, when broken, form the intersections of the sides of and define the octagonal shape of the open carton.

Figure 4B:
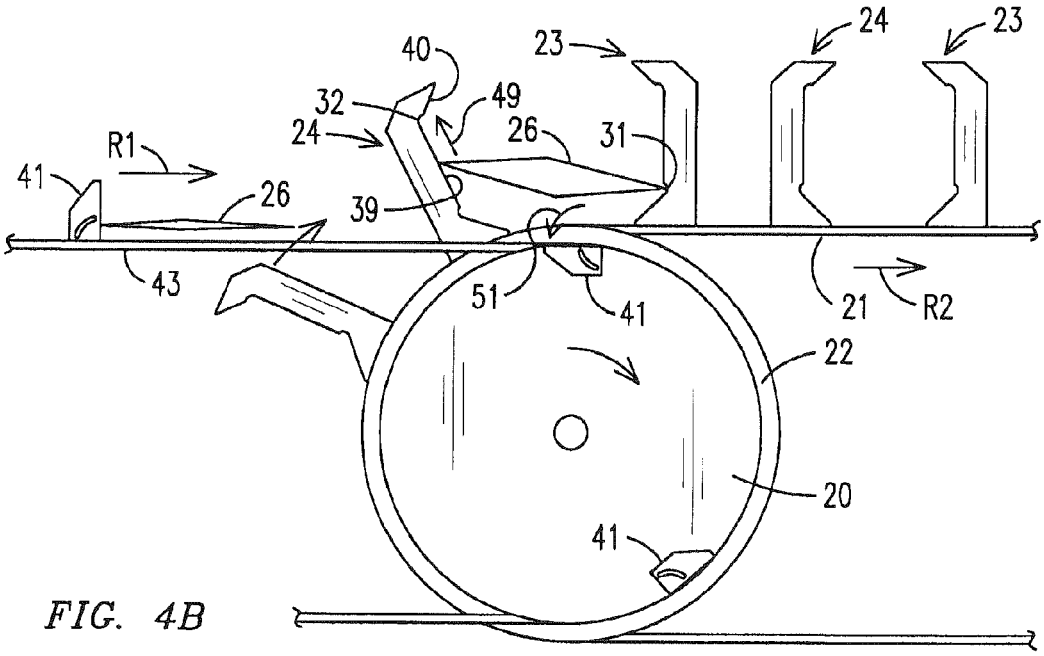
Figure 4C:
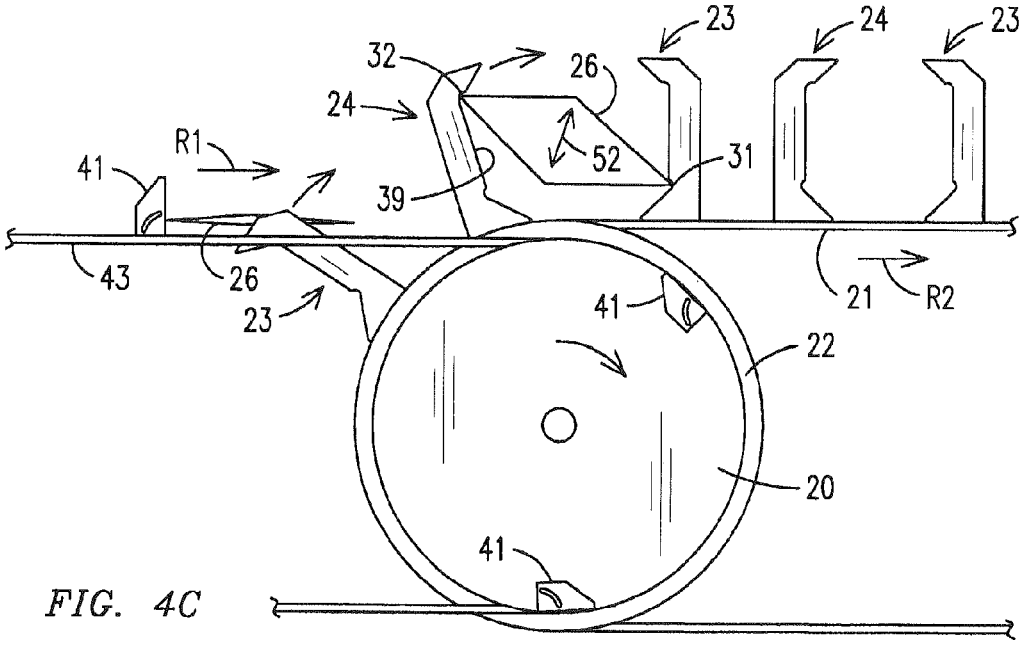

In FIG. 4*b*, the trailing flight lug 24 has moved further around the sprocket and is shown closing the angle and the space between itself and the leading lug 23. Since the leading edge of the carton blank is lodged in the notch 31 of the leading lug, this movement of the trailing flight lug causes the trailing edge of the carton blank to slide up the middle surface 39 of the trailing flight lug toward the notch 32 formed at the bottom of the upper surface 40, as indicated by arrow 49. The carton blank is thus progressively raised up off of the carton flight 21. In FIG. 4*c*, the trailing flight lug has advanced further around the sprocket assembly and the un-erected carton blank 26 is now captured with its leading edge lodged in the lower notch 31 of the leading flight lug 23 and with its trailing edge lodged in the upper notch 32 of the trailing flight lug 24. The carton blank is thus elevated above the upper carton flight assembly 21 as illustrated and is beginning to open up as a result of the closing of the space between the leading and trailing flight lugs, as indicated at 52. In the mean time, the next carton blank is being progressively advanced toward the carton conveyor by the next successive articulating lug 41 as shown.

Figure 4D:
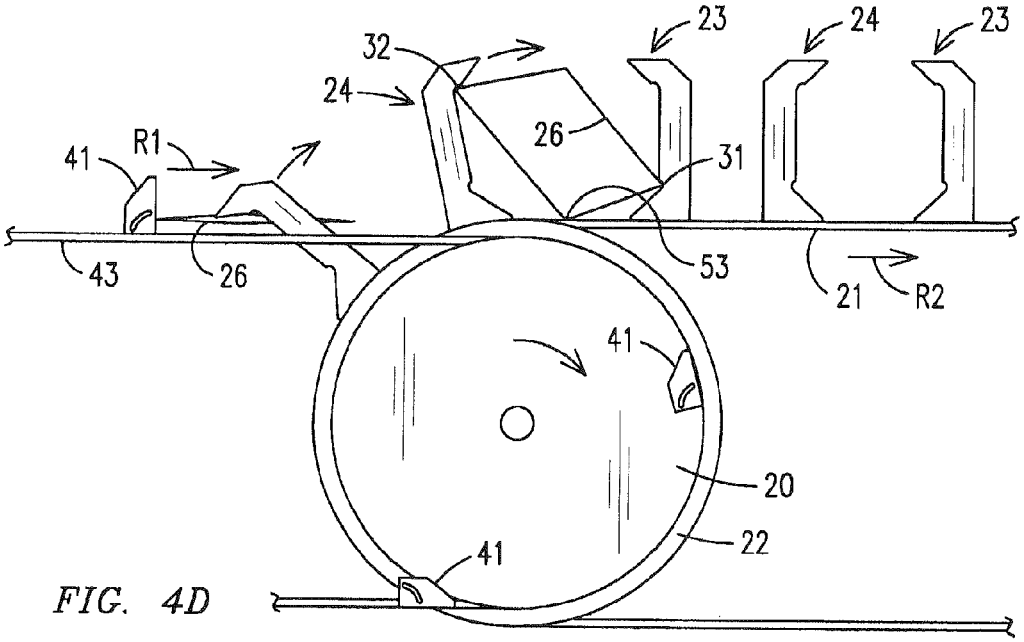

In FIG. 4*d*, the further advancement of the trailing flight lug 24 around the sprocket assembly and toward the leading flight lug has begun to cause the carton blank 26 to open up further from its substantially flat configuration and one of the corners of the carton blank is seen contacting the upper carton flight of the conveyor at 53. The carton blank is now confined between three points, namely the notches 31 and 32 and the upper flight of the carton conveyor.

Figure 4E:
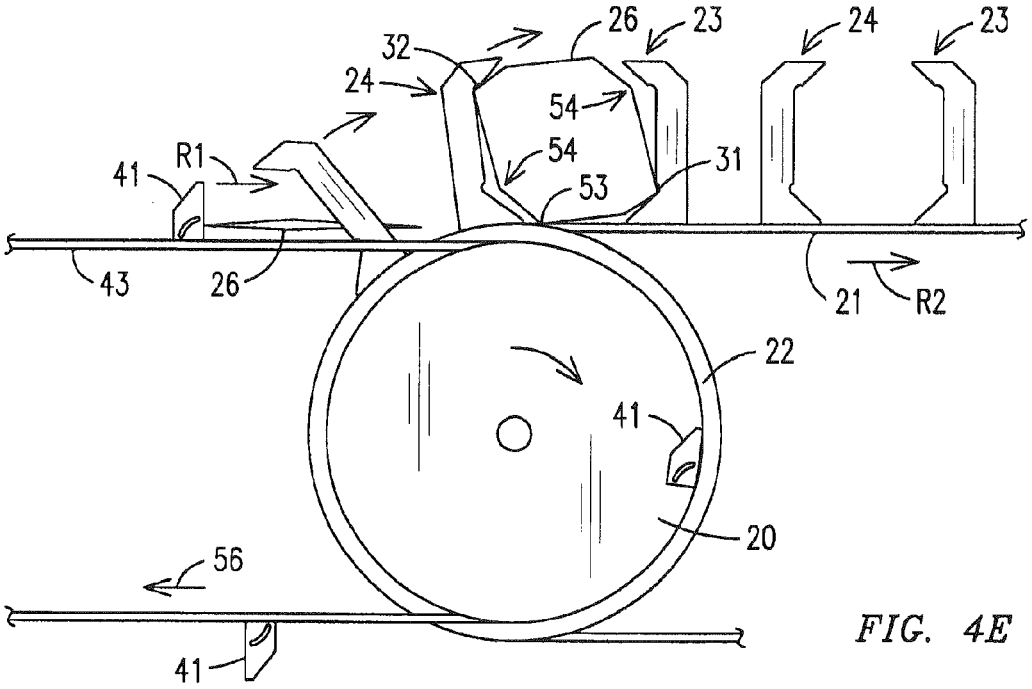

FIG. 4*e* shows the further advancement of the trailing flight lug, which, because of the three point confinement of the blank, begins to cause the crease lines at additional corners of the octagonal carton to break and begin to bend. It should be noted that the crease lines may break in various orders as slightly weaker crease lines break before slightly stronger crease lines. It has been found, however, that the order in which the crease lines break does not affect the effectiveness of the moving leading and trailing lugs to erect the cartons between themselves as they move together with respect to one another.

Figure 4F:
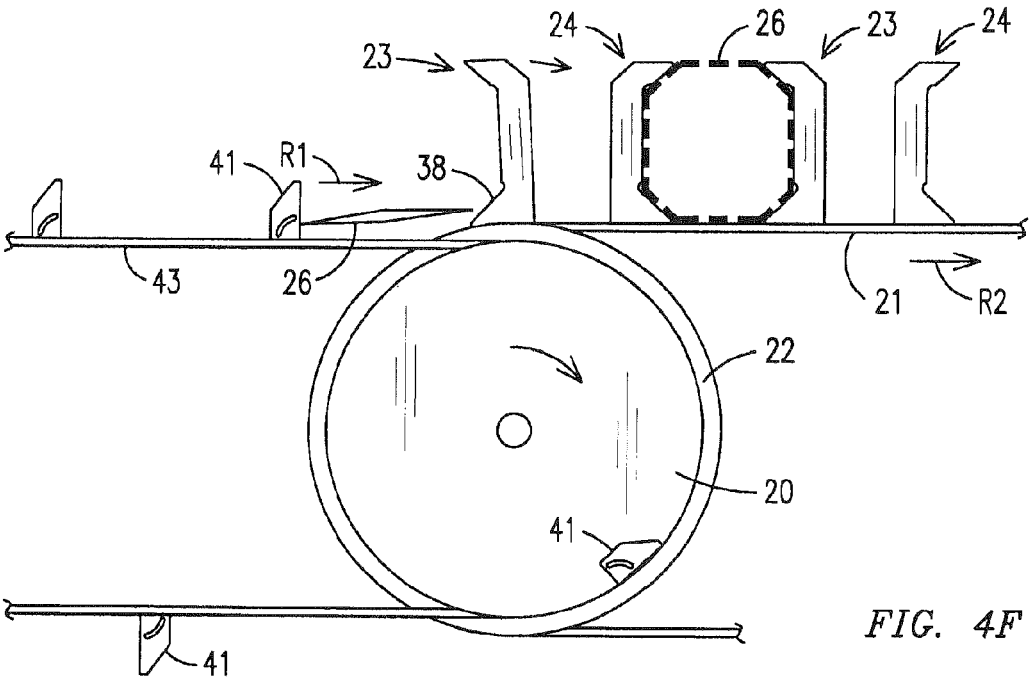

Finally, FIG. 4*f* shows the leading and trailing flight lugs 23 and 24 both fully moved onto the upper flight of the conveyor and oriented vertically and substantially parallel to each other. The carton blank 26, which has just been erected as described, is now captured between the opposing recesses of the leading and trailing flight lugs. The shapes of and relative angles between the three surfaces of each flight lug conforms the surfaces to six of the eight sides of the octagonal carton as shown. This functions to maintain the erected carton in its octagonal shape as well as confining the carton and moving it with the flight lugs in a downstream direction for receiving an article or articles in known ways. Preferably, the extreme leading and trailing sides of the octagonal carton are slightly spaced from the middle surfaces of the recesses to prevent binding and for other reasons, but this is not a requirement of the invention. At the same time, the leading edge of the next successive carton blank 26 is shown just about to be driven against the lower surface 38 of the next successive leading lug 23 for erection of the next carton blank in the same way as described above. In this way, octagonal carton blanks are erected sequentially and conveyed along the carton flight in spaced relationship for receiving and article or articles to be packaged therein.

The relative motion of leading and trailing flight lugs has been described as occurring when the trailing flight lugs round the upstream sprocket of the carton conveyor. Alternative methods encompassed by the invention, however, may include pivoting or otherwise moving the leading flight lugs toward the trailing flight lugs, pivoting or otherwise moving the trailing flight lugs toward the leading flight lugs, or combinations of both, after the flight lugs have moved fully onto the upper carton flight of the conveyor. This might be accomplished, for example, with an appropriate cam and cam follower arrangement, with a static rail arrangement, or by another technique commonly used to orient components in high speed packaging machines. In either case, the erection of the octagonal carton and subsequent capturing of the carton between the leading and trailing flight lugs is accomplished. The lugs also may be moved together on the upper flight of the carton conveyor with an appropriate phasing drive mechanism; however, the complexity of such a technique makes it less desirable in many situations. Further, while highly useful for erecting and confining octagonal cartons, the method and apparatus of this invention might also be used to erect and confine cartons with shapes and profiles other than octagonal with equivalent results. In such cases, the faces of the lugs are appropriately designed to confine cartons having a shape other than octagonal.

The invention has been described herein in terms of preferred embodiments and methodologies considered by the inventor to represent the best mode of carrying out the invention. It will be understood by those of skill in the art that a wide variety of additions, deletions, and modifications, both subtle and gross, might well be made by those of skill in the art without departing from the spirit and scope of the invention, which is delimited only by the claims.

What is claimed is:

1. A flight lug for a carton conveyor of an article packaging machine, the flight lug comprising a body having a first end configured to be secured to an endless chain of the carton conveyor and a second end, and a recess formed in the body between the first end and the second end configured to conform substantially to the shape of a portion of an erected carton, the recess is formed by a lower surface, a middle surface, and an upper surface, the lower surface being oblique with respect to the middle surface, the upper surface being oblique with respect to the middle surface, the recess comprises at least one notch that comprises an upper notch in the upper surface and a lower notch in the middle surface.

2. The flight lug of claim 1, wherein the at least one notch is positioned to engage an edge of a carton blank as the flight lug and carton blank move into engagement with each other.

3. The flight lug of claim 2, wherein the lower notch is formed at the bottom of the middle surface and adjacent to the lower surface.

4. The flight lug of claim 3, wherein the upper notch is formed at the bottom of the upper surface and adjacent to the middle surface.

5. The flight lug of claim 1, wherein the lower surface is disposed at an angle of about 45 degrees relative to the middle surface.

6. The flight lug of claim 5, wherein the upper surface is disposed at an angle of about 45 degrees relative to the middle surface.

7. The flight lug of claim 5, wherein a lower portion of the body comprises the first end of the flight lug that is configured to be secured to a chain of a carton conveyor.

8. A flight lug comprising an elongated body and a recess formed in the body, the recess is formed by a plurality of surfaces and is configured to conform substantially to the shape of a portion of an erected carton, the plurality of surfaces comprising a first surface, a second surface, and a third surface, the first surface and the third surface are disposed at respective oblique angles with respect to the second surface, the recess comprises at least one notch that comprises a first notch formed in the first surface and a second notch formed in the second surface.

9. The flight lug of claim 8, wherein the first and second surfaces meet at a first intersection and the second and third surfaces meet at a second intersection, the first notch formed at the first intersection and sized to capture an edge of a carton blank.

10. The flight lug of claim 9, wherein at the second notch is formed at the second intersection and sized to capture an edge of a carton blank.

11. The flight lug of claim 8, wherein the first surface and the third surface are disposed at approximately 45 degree angles relative to the second surface.

12. The flight lug of claim 1, wherein each of the lower notch and the upper notch is recessed into a portion of the respective middle surface and the upper surface.

13. The flight lug of claim 8, wherein each of the first notch and the second notch is recessed into a portion of the respective first surface and the second surface.

14. A set of flight lugs for a carton conveyor of an article packaging machine, the set of flight lugs comprising:

a leading flight lug comprising a recess with a lower surface, a middle surface, and an upper surface, the lower surface and the upper surface are disposed at respective oblique angles relative to the middle surface, a notch is formed in the middle surface; and a trailing flight lug comprising a recess with a lower surface, a middle surface, and an upper surface, the lower surface and the upper surface are disposed at respective oblique angles relative to the middle surface;

the leading flight lug and the trailing flight lug are each configured to at least partially receive a carton in an un-erected configuration, the leading flight lug and the trailing flight lug are arranged to move toward one another such that a leading edge of the carton in the un-erected configuration slides along the lower surface of the leading flight lug to engage the notch and erect the carton from the un-erected configuration to an erected configuration.

15. The set of flight lugs of claim 14, wherein the notch is a lower notch, and the leading flight lug further comprises an upper notch in the upper surface.

16. The set of flight lugs of claim 15, wherein the trailing flight lug comprises a lower notch in the middle surface and an upper notch in the upper surface.

* * * * *